US010422159B2

(12) United States Patent
Nepsha et al.

(10) Patent No.: US 10,422,159 B2
(45) Date of Patent: Sep. 24, 2019

(54) ADJUSTABLE ROD GUIDE

(71) Applicant: Hoffman Enclosures, Inc., Anoka, MN (US)

(72) Inventors: William J. Nepsha, Zimmerman, MN (US); Bruce W. Larson, Andover, MN (US)

(73) Assignee: Hoffman Enclosures, Inc., Anoka, MN (US)

( * ) Notice: Subject to any disclaimer, the term of this patent is extended or adjusted under 35 U.S.C. 154(b) by 608 days.

(21) Appl. No.: 15/050,282

(22) Filed: Feb. 22, 2016

(65) Prior Publication Data

US 2016/0244993 A1 Aug. 25, 2016

Related U.S. Application Data

(60) Provisional application No. 62/119,722, filed on Feb. 23, 2015.

(51) Int. Cl.

| | |
|---|---|
| ***E05B 15/00*** | (2006.01) |
| ***E05C 1/08*** | (2006.01) |
| *E05B 63/00* | (2006.01) |

(52) U.S. Cl.

CPC ..... *E05B 15/00* (2013.01); *E05C 1/08* (2013.01); *E05B 63/0056* (2013.01); *Y10S 292/51* (2013.01)

(58) Field of Classification Search

CPC ..... E05B 15/00; E05B 63/0056; E05C 9/043; E05C 9/22; E05C 1/08; Y10S 292/51; Y10S 292/55; Y10S 292/60; F16B 5/0233

USPC ..... 411/427, 546; 292/32, 137

See application file for complete search history.

(56) References Cited

U.S. PATENT DOCUMENTS

| | | | | |
|---|---|---|---|---|
| 476,037 | A * | 5/1892 | Colton | E05F 11/00 292/305 |
| 495,761 | A | 4/1893 | Shepard | |
| 1,224,302 | A | 5/1917 | Johnson | |
| 1,524,234 | A | 1/1925 | Carter | |

(Continued)

FOREIGN PATENT DOCUMENTS

| | | | |
|---|---|---|---|
| CN | 2931712 Y | 8/2007 | |
| DE | 2150467 A1 * | 4/1973 | F16B 2/04 |

(Continued)

OTHER PUBLICATIONS

Installation sheet padlock door handle; 1pp; Saginaw Control & Engineering SCE-ARK36 Installation; downloaded from Saginaw website on Feb. 3, 2016; <http://www.saginawcontrol.com/instman/spec-handle-instman.pdf>.

(Continued)

*Primary Examiner* — Carlos Lugo

(74) *Attorney, Agent, or Firm* — Quarles & Brady LLP

(57) ABSTRACT

Embodiments of the invention provide a rod guide for mounting a latch rod to an enclosure. A guide member can include a guide-member support surface and a guide opening to receive the latch rod. A base member can include a base-member support surface. The base member can support the guide member with the guide opening at different distances from the surface of the enclosure when the guide-member support surface is seated on the base-member support surface with the guide member disposed at different respective rotational orientations relative to the base member.

19 Claims, 13 Drawing Sheets

(56) References Cited

U.S. PATENT DOCUMENTS

| | | | | |
|---|---|---|---|---|
| 1,792,345 | A | 2/1931 | William | |
| 3,036,401 | A | 5/1962 | Stark | |
| 3,082,800 | A | 3/1963 | Soss | |
| 3,203,104 | A | 8/1965 | Heathington | |
| 3,537,166 | A | 11/1970 | Matyas | |
| 3,756,671 | A | 9/1973 | White | |
| 3,834,034 | A | 9/1974 | Berquist | |
| 4,015,454 | A * | 4/1977 | Struble | E05C 1/08 292/150 |
| 4,146,994 | A | 4/1979 | Williams | |
| 4,433,879 | A * | 2/1984 | Morris | F16B 43/009 384/626 |
| 4,479,627 | A | 10/1984 | Wehner | |
| 4,567,660 | A * | 2/1986 | Sakata | F16B 2/065 292/305 |
| 4,682,906 | A * | 7/1987 | Ruckert | F16B 5/0233 384/626 |
| 4,791,732 | A | 12/1988 | Bruno, Jr. et al. | |
| 4,794,700 | A | 1/1989 | Kessel | |
| 4,873,769 | A | 10/1989 | Casanave | |
| 4,952,101 | A | 8/1990 | Coombs | |
| 6,041,627 | A | 3/2000 | Buckland | |
| 6,062,984 | A | 5/2000 | Ju | |
| 6,086,121 | A * | 7/2000 | Buckland | E05C 9/043 292/161 |
| 6,113,160 | A | 9/2000 | Johansson et al. | |
| 6,116,660 | A | 9/2000 | Langkamp, Jr. et al. | |
| 6,296,286 | B2 | 10/2001 | Glaser et al. | |
| 6,439,015 | B1 | 8/2002 | Sauerland et al. | |
| 6,508,494 | B1 | 1/2003 | Reuter et al. | |
| 6,575,503 | B1 | 6/2003 | Johansson et al. | |
| 6,592,155 | B1 * | 7/2003 | Lemley | E05B 67/38 292/33 |
| 6,871,884 | B2 | 3/2005 | Hoffmann et al. | |
| 7,189,035 | B2 | 3/2007 | Miro | |
| 7,340,928 | B2 | 3/2008 | Hoffman | |
| 7,584,634 | B2 | 9/2009 | Hoffman | |
| 8,070,561 | B2 | 12/2011 | Lifters et al. | |
| 8,176,758 | B2 | 5/2012 | Ramsauer et al. | |
| 8,459,703 | B2 | 6/2013 | Anderson et al. | |
| 8,517,435 | B2 | 8/2013 | Runge | |
| 8,733,717 | B2 | 5/2014 | Devereux | |
| 2005/0001132 | A1 | 1/2005 | Machael et al. | |
| 2006/0236732 | A1 | 10/2006 | Hoffman | |
| 2008/0190150 | A1 | 8/2008 | Hoffman | |
| 2010/0143066 | A1 * | 6/2010 | Ramsauer | F16B 37/0878 411/116 |
| 2010/0201136 | A1 | 8/2010 | Ramsauer | |
| 2010/0244641 | A1 | 9/2010 | Bergesch et al. | |
| 2014/0314524 | A1 | 10/2014 | Skopnik | |
| 2015/0184435 | A1 * | 7/2015 | Ramsauer | E05B 63/0056 292/337 |

FOREIGN PATENT DOCUMENTS

| | | | | |
|---|---|---|---|---|
| DE | 2754371 | A1 * | 6/1979 | F16B 5/0233 |
| DE | 4013441 | A1 | 11/1991 | |
| EP | 2767628 | A1 | 8/2014 | |
| WO | 2014108314 | A1 | 7/2014 | |

OTHER PUBLICATIONS

Part information sheet; 1pp; Saginaw Control & Engineering SCE-103370; downloaded from Saginaw website on Feb. 3, 2016; <http://www.saginawcontrol.com/download.php?PartNumber=SCE-103370>.

Part information sheet: 1pp; Saginaw Control & Engineering SCE-ARK36; downloaded from Saginaw website on Feb. 3, 2016; <http://www.saginawcontrol.com/download.php?PartNumber=SCE-ARK36>.

International Search Report and Written Opinion for PCT/US 16/18977; dated Jun. 3, 2016; 43 pages.

* cited by examiner

ADJUSTABLE ROD GUIDE

RELATED APPLICATIONS

This application claims priority under 35 U.S.C. § 119 to U.S. Provisional Patent Application No. 62/119,722 filed on Feb. 23, 2015, the entire contents of which are incorporated herein by reference.

BACKGROUND

Enclosures, such as cabinet enclosures used to house electrical and datacom equipment, can include latch systems to secure doors of the enclosures in a closed orientation. A conventional latch system for an enclosure door can include a cam, which can be mounted to the door and can be rotated using a handle on the exterior of the door. Rods can be attached to the cam, such that rotation of the cam moves the rods between latched and unlatched configurations. For example, rotating the handle in one direction can rotate the cam such that the rods are moved to engage openings or catches on the enclosure and thereby prevent the door from opening. This can be viewed as a latched configuration for the rods, and for the latch system as a whole. In contrast, when the cam is rotated in the other direction, this can move the rods to disengage from the openings or catches and thereby allow the door to be opened. This can be viewed as an unlatched configuration for the rods, and for the latch system as a whole.

Rods for a latch system can be at least partly secured to the relevant door by rod guides, with the rod guides guiding movement of the rods between the latched and unlatched configurations. For example, in the conventional latch system with a cam as described above, a rod guide with a guide opening can be attached to an enclosure door and a rod disposed through the guide opening. As the cam rotates, the guide opening can help to guide the movement of the rod between the latched and unlatched configurations.

Some conventional rod guides can be adjusted to a limited degree. For example, in some conventional rod guides, a guide pin can be moved between different pairs of mounting holes to hold the rod at different orientations.

Some conventional enclosures can be equipped with gaskets or other seals between the enclosure doors and other features of the enclosures (e.g., body flanges surrounding a door opening). In some cases, latch systems for these enclosures can also serve to compress the gasket or other seal between the doors and these other features when the doors are closed. For example, when rods of a conventional latch system are moved into the latched configuration, the engagement of the rods with the enclosure (e.g., with openings or catches on the enclosure) can urge the door more tightly against a gasket between the door and the enclosure. This may help to ensure that liquids or other materials do not leak into the enclosure.

However, different gaskets or other seals for enclosures can exhibit different thicknesses, durometer values, or other aspects, depending on the needs of a particular enclosure or enclosure installation. Further, different enclosures can exhibit different physical characteristics or features that can affect the amount of compression applied to the relevant gasket (or other seal) for a given orientation of the relevant door. For example, different enclosures can exhibit different body flange heights or angles, which can result in different amounts of gasket compression for a given orientation of the enclosure doors. Accordingly, conventional latch systems, with their limited adjustability, may not ensure optimal sealing for all enclosure configurations.

SUMMARY

Some embodiments of the invention provide a rod guide for mounting a latch rod relative to an enclosure. A guide member can include a guide-member helical surface and a guide opening to receive the latch rod. A base member can be configured to attach to a surface of the enclosure, and can include a base-member helical surface. The base member can support the guide member with the guide opening disposed at different distances from the surface of the enclosure when the guide-member helical surface is seated on the base-member helical surface with the guide member disposed at different respective rotational orientations relative to the base member.

Some embodiments of the invention provide a latching system for a door of an enclosure. A guide member can include a guide-member support surface and a guide opening. A latch rod can be received in the guide opening. A base member can be configured to rotatably attach to an interior surface of the door, and can include a base-member support surface. The base member can support the guide member with the guide opening disposed at different distances from the interior surface of the door when the guide-member support surface is seated on the base-member support surface with the guide member disposed at different respective rotational orientations relative to the base member. The latch rod can be disposed at different respective operational distances from the interior surface of the door when the guide opening is disposed at the different distances from the interior surface of the door. The guide member and the base member can be collectively rotatable relative to the interior surface of the door when the base member is attached to the interior surface of the door and the guide-member support surface is seated on the base-member support surface.

Some embodiments of the invention provide a rod guide for mounting a latch rod relative to an enclosure. A guide member can include a first guide-member helical surface and a guide opening to receive the latch rod. A base member can be configured to attach to a surface of the enclosure, and can include a first base-member helical surface. A first protrusion can extend out of one of the first guide-member helical surface and the first base-member helical surface. A first plurality of recesses can extend into a different one of the first guide-member helical surface and the first base-member helical surface. The base member can support the guide member relative to the surface of the enclosure via the first guide-member helical surface being seated on the first base-member helical surface.

When the base member is attached to the surface of the enclosure and the first guide-member helical surface is seated on the first base-member helical surface with the guide member disposed at a first rotational orientation relative to the base member, the guide opening can be disposed at a first distance from the surface of the enclosure, and the first protrusion can extend into a first recess of the first plurality of recesses to secure the guide-member at the first rotational orientation relative to the base member and to secure the guide opening at the first distance from the surface of the enclosure.

When the base member is attached to the surface of the enclosure and the first guide-member helical surface is seated on the first base-member helical surface with the guide member disposed at a second rotational orientation relative to the base member, the guide opening can be disposed at a second distance from the surface of the enclosure, and the first protrusion cam extend into a second recess of the first plurality of recesses to secure the guide-member at the second rotational orientation relative to the base member and to secure the guide opening at the second distance from the surface of the enclosure.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Figure 1:
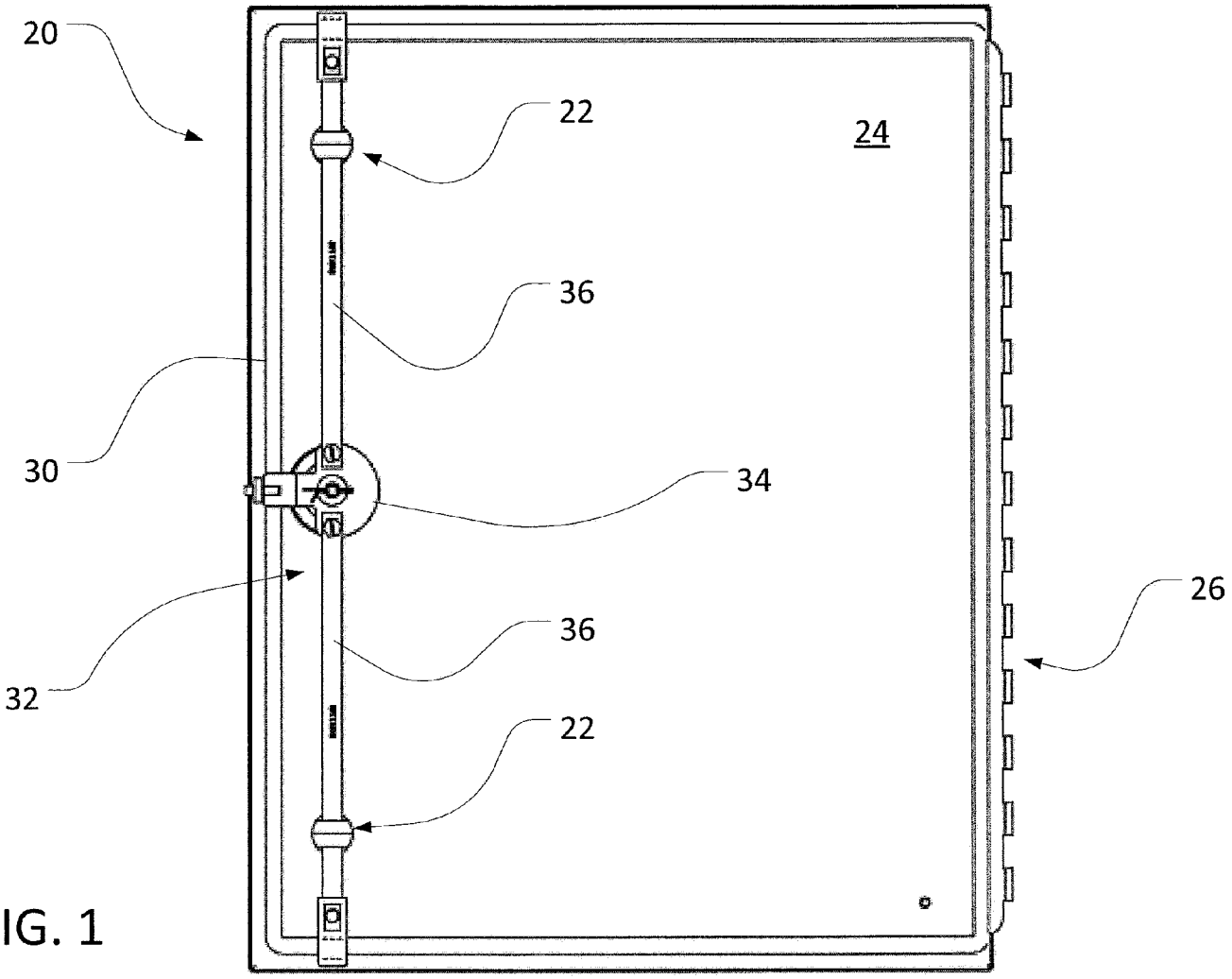
FIG. 1 is a rear elevation view of an enclosure door with a latch system in a latched configuration, including a rod guide according to one embodiment of the disclosure.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

As used herein, unless otherwise specified or limited, the phrases "at least one of A, B, and C," "one or more of A, B, and C," and the like, are meant to indicate A, or B, or C, or any combination of A, B, and/or C, including combinations with multiple instances of A, B, and/or C and combinations with individual instances of A, B, and/or C.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Some figures may include multiple instances of similar structures or structural relationships. For convenience of presentation, in select figures, only some of these similar structures or relationships may be specifically labeled with a reference number. One of skill in the art will recognize that the features not labeled with reference numbers can include similar aspects and perform similar functions to similar features that are labeled with reference numbers.

The disclosed adjustable rod guide can provide various improvements over conventional rod guides and rod guides. In some embodiments, for example, a support surface of a guide member can be configured to seat on a support surface of a base member attached to an enclosure door with the guide member in one of a plurality of rotational orientations relative to the base member. Based on particular rotational orientation of the guide member relative to the base member when the guide member is seated on the base member (via the support surfaces), the base member can support the guide member with a guide opening of the guide member at different distances from the door.

This may usefully allow a single rod guide to adjustably accommodate many different enclosure configurations. For example, for enclosures with relatively thick gaskets, the guide member can be rotated relative to the base member so that the guide opening is disposed a relatively large distance from the enclosure door, and for enclosures with relatively thin gaskets, the guide member can be rotated relative to the base member so that the guide opening is disposed a relatively small distance from the enclosure door. Similarly, different guide opening heights (by way of different relative rotational orientations of the guide member) can be employed to accommodate other variations in enclosure configurations, including variations in body flange geometry among different enclosures.

In some embodiments, the support surface of the guide member can exhibit a generally complimentary geometry to the support surface of the base member, such that the support surfaces can be seated relatively snugly together when the base member supports the guide member. In some embodiments, the respective support surfaces can be configured as helical surfaces with complimentary slopes.

In some embodiments, support surfaces of the guide member and the base member can include complimentary engagement features, such as complimentary protrusions and recesses, which can be configured to engage each other when the guide member is in one or more predetermined rotational orientations relative to the base member. This can be useful, for example, in order to define predetermined distances of the guide opening of the guide member from the relevant surface (e.g., the interior of an enclosure door).

In discussion herein, some embodiments of the invention may be discussed in the context of particular enclosures, enclosure doors, or latching systems. It will be understood that such enclosures, enclosure doors, and latching systems are presented as examples only, and that the disclosed rod guide can be used in various other contexts.

Figure 2:
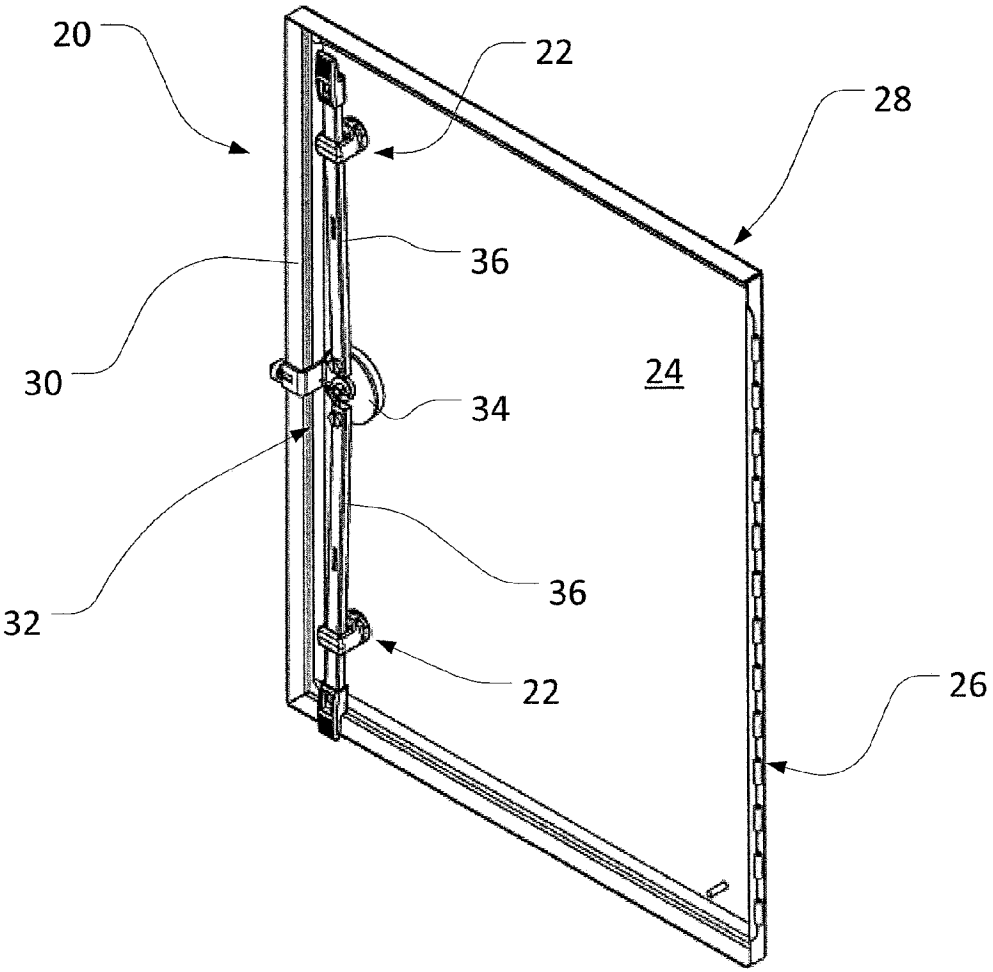
FIG. 2 is a right, rear, top perspective view of the enclosure door of FIG. 1.
Figure 3:
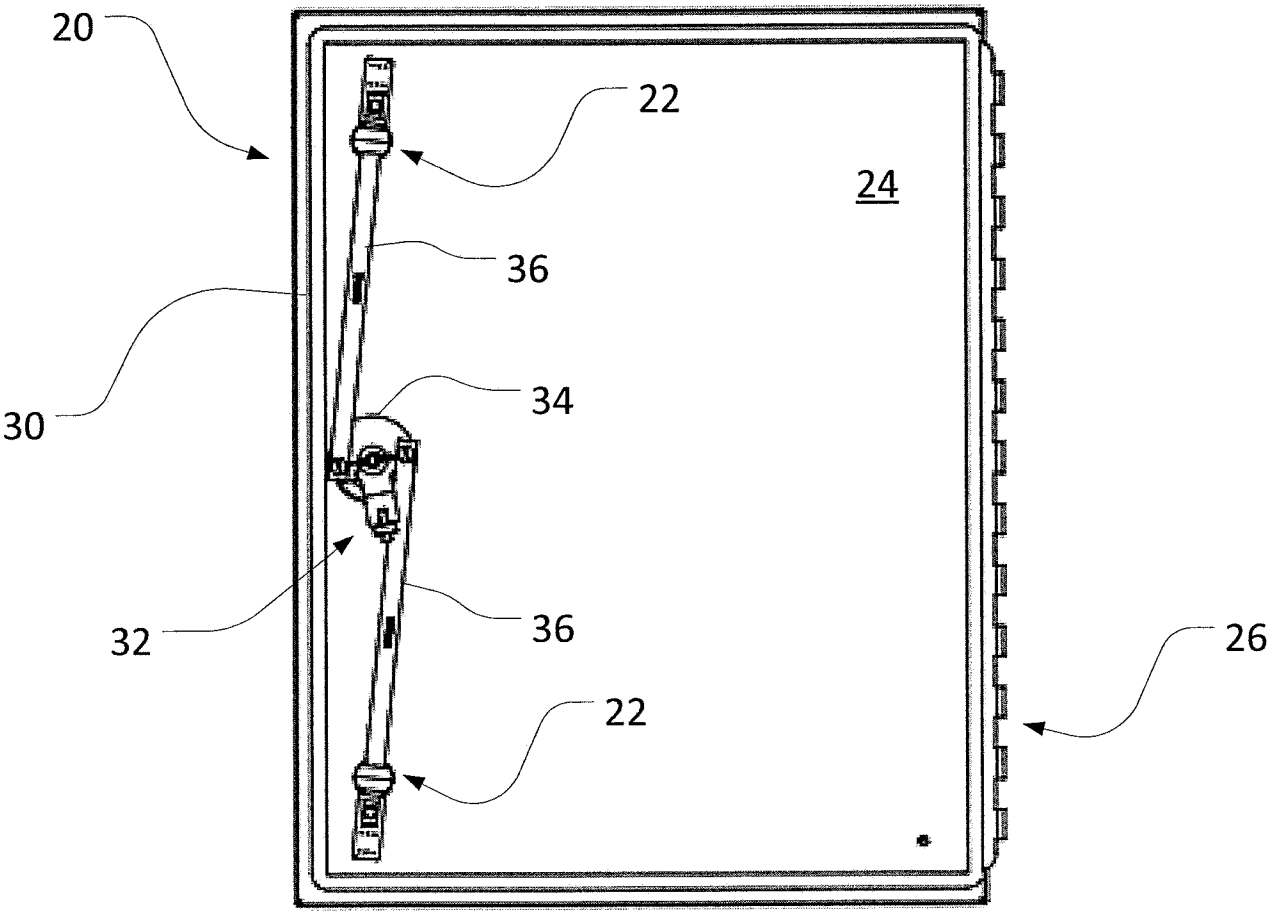
FIG. 3 is a rear elevation view of the enclosure door of FIG. 1, with the latch system in an unlatched configuration.

FIGS. 1 through 3 illustrate an enclosure door 20 with rod guides 22 according to one embodiment of the invention. The enclosure door 20 is configured as a sheet metal door with a generally planar interior surface 24. Hinges 26 at one side of the enclosure door 20 are configured to engage with complimentary hinges (not shown) on a body of an enclosure (not shown), so that the enclosure door 20 can pivot about the hinges 26 in order to open or close. Generally, when the enclosure door 20 is closed, the interior surface 24 faces the interior of the enclosure, with an exterior surface 28 (as indicated in FIG. 2) facing outwards. In the embodiment illustrated, the rod guides 22 are attached to door 20 so that the rod guides 22 are disposed on the interior surface 24 of the enclosure door 20 and are thereby disposed within the interior of the enclosure when the enclosure door 20 is closed.

A gasket 30, such as a rubber or other polymer gasket, is disposed on the interior surface 24 of the enclosure door 20. The gasket 30 is generally configured to engage with features on the enclosure body, such that an appropriate seal is formed between the enclosure door 20 and the enclosure body when the enclosure door 20 is closed. For example, the enclosure body can include a body flange (not shown) of various heights, angles, or other characteristics. Depending on the height, angle or other characteristics of the body flange, a particular orientation of the enclosure door 20 relative to the body flange can provide an appropriately tight seal between the gasket 30 and the body flange.

To help control latching of the door, the rod guides 22 can form part of a latching system 32 that is attached to the enclosure door 20. In addition to the rod guides 22, the latching system 32 includes a cam 34, which is disposed on the interior of the enclosure door 20, and two latch rods 36. The latch rods 36 are pivotally attached to the cam 34, so that when the cam 34 rotates the latch rods 36 are moved with respect to the enclosure door 20. A handle (not shown) extending from the exterior surface 28 of the enclosure door 20 (see FIG. 2) can be actuated in order to rotate the cam 34. Depending on the direction of rotation of the cam 34, the latch rods 36 can therefore be moved generally outward into a latched configuration (see FIGS. 1 and 2) or generally inward into an unlatched configuration (see FIG. 3). Usefully, as illustrated in FIGS. 2 and 3 in particular, the rod guides 22 can rotate relative to the interior surface 24 of the enclosure door 20 as the latch rods 36 are moved between the latched and unlatched configurations.

In the unlatched configuration, the latch rods 36 can allow the enclosure door 20 to be opened, as may be useful to allow an operator to access the interior of the enclosure. In the latched configuration, the latch rods 36 can engage with features on the enclosure body (not shown) in order to prevent the enclosure door 20 from being opened. In some embodiments, moving the latch rods 36 in to the latched configuration can cause and maintain appropriate compression of the gasket 30 by urging the gasket 30 against a body flange (or other feature) of the enclosure and by preventing the door from being opened once the gasket 30 has been compressed. In some embodiments, it may be possible to move the latch rods 36 into the latched configuration only after the gasket 30 has been suitably compressed by the closed door 20.

As noted above, the orientation of the enclosure door 20 when the enclosure door 20 is fully closed may vary depending on the thickness of the gasket 30 (or other aspects of the enclosure). Accordingly, as also noted above, it may be useful for the rod guides 22 to be adjustable, in order to dispose the latch rods 36 at the appropriate distance from the interior surface 24 of the enclosure door 20 for the latch rods 36 to engage the relevant latching features on the enclosure body.

Figure 4:
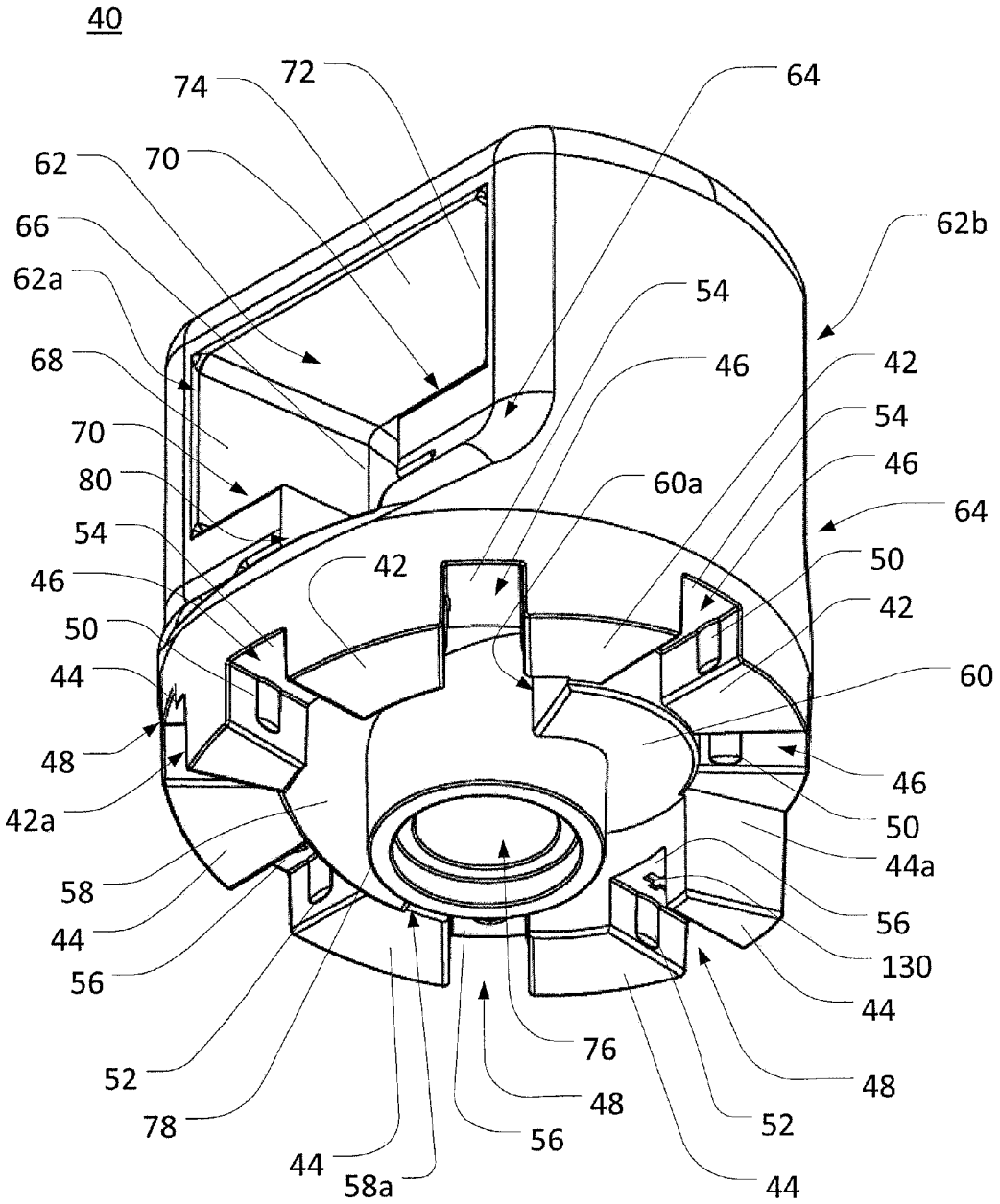
FIG. 4 is left, front, bottom perspective view of a guide member for the rod guide of FIG. 1.

FIG. 4 illustrates a guide member 40 for inclusion in either of the rod guides 22, according to one embodiment of the invention. In the embodiment illustrated, the bottom of the guide member 40 includes a set of radially outer support surfaces configured as helical surfaces 42 and 44. Each of the helical surfaces 42 and 44 extends approximately halfway around a local circumference of the guide member 40 and slopes generally downward along the clockwise direction (as viewed from the bottom of the guide member 40). A generally vertical stop **42*a* is included between the helical surface 42 and the helical surface 44, and a generally vertical stop 44*a* is provided between the helical surface 44 and the helical surface 42**. In other embodiments, different configurations of support surfaces are possible.

In the embodiment illustrated, the helical surfaces 42 and 44 are interrupted by engagement features configured as recesses 46 and 48 that extend upward into the helical surfaces 42 and 44, respectively. The recesses 46 and 48 are configured as rectangular recesses, with internal protrusions 50 and 52 and inner end walls 54 and 56. In other embodiments, other configurations are possible, including rounded, triangular (or "angled"), or other recesses, or different types of protrusions.

The guide member 40 also includes a set of radially inner support surfaces configured as helical surfaces 58 and 60. Each of the helical surfaces 58 and 60 extend approximately halfway around a local circumference of the guide member 40 and slope generally downward along the clockwise direction (as viewed from the bottom of the guide member 40). A generally vertical stop **58*a* is included between the helical surface 58 and the helical surface 60, and a generally vertical stop 60*a* is provided between the helical surface 60 and the helical surface 58. In the embodiment illustrated, each of the stops 58*a* and 60*a* is disposed approximately halfway between the stops 42*a* and 44*a* of the helical surfaces 42 and 44**. In other embodiments, other configurations are possible.

In the embodiment illustrated, the helical surfaces 58 and 60 are not interrupted by engagement features such as protrusions or recesses. In other embodiments, other configurations are possible. For example, in some embodiments, one or both of the helical surfaces 58 and 60 can be interrupted by recesses (not shown) similar to the recesses 46 and 48 as an alternative (or in addition) to the helical surfaces 58 and 60 being interrupted by the recesses 46 and 48. Similarly, in some embodiments, one or both of the helical surfaces 58 and 60 can be interrupted by engagement features configured as one or more protrusions.

The guide member 40 also includes a guide opening 62 sized to slidably receive one of the latch rods 36 in order to guide movement of the relevant latch rod 36. Generally, the guide opening 62 defines a rod-guide passage that extends through a tapered upper portion 64 of the guide member 40. In the embodiment illustrated, the rod-guide passage exhibits an inwardly tapering rectangular cross section, with a central region of the rod-guide passage (e.g., at a mid-point 66, shown on a side wall 68 in FIG. 4) exhibiting a smaller cross section than open ends 62*a* and 62*b* of the rod-guide passage.

A lower end of the rod-guide passage includes a shelf 70 to support a latch rod, as well as the side wall 68, the side wall 72, and a top wall 74 to retain the latch rod within the guide opening 62. In the embodiment depicted, the shelf 70 is a divided shelf, with a gap between two separate support surfaces. In other embodiments, the shelf 70 can be configured with a single continuous support surface.

The guide member 40 also includes a central attachment opening 76 extending axially through the guide member 40 between a downwardly-extending boss 78 and a fastener recess 80. The fastener recess 80 can be generally configured to receive and hold a first fastener, such as a nut, to engage a second fastener, such as a screw, bolt, rod or peg, that has been extended through the attachment opening 76. In the embodiment illustrated, for example, the fastener recess 80 is configured as a partially open rectangular channel that can receive and hold a nut (e.g., a square nut) while preventing the nut from turning. In some embodiments, the opening in the shelf 70 (as also discussed above), can provide for relatively easy access to a fastener that has been received in the fastener recess 80. For example, as needed, an operator can reach through the opening in the shelf 70 to move a nut or other fastener from the fastener recess 80.

Figure 5:
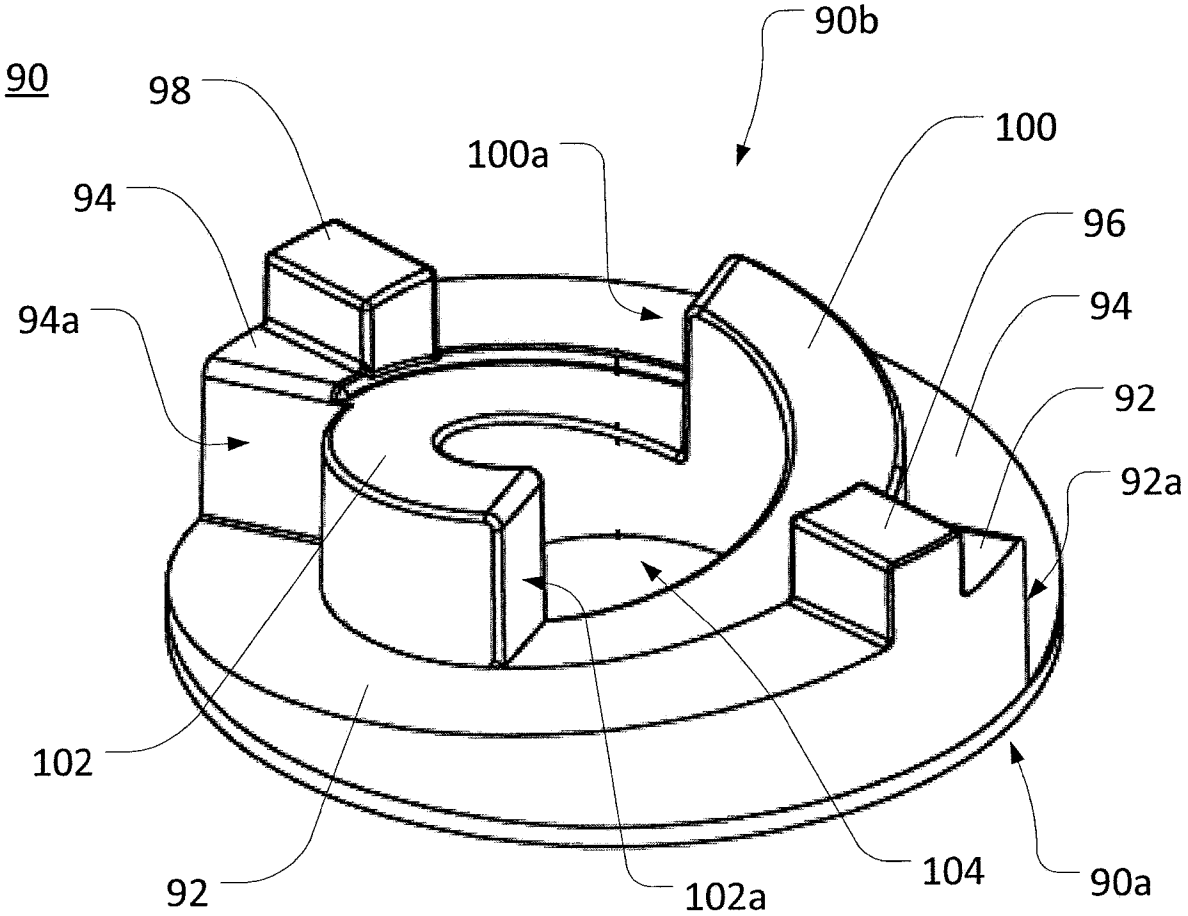
FIG. 5 is a left, front, top perspective view of a base member for the rod guide of FIG. 1.

FIG. 5 illustrates a base member 90 for use with the guide member 40, according to one embodiment of the invention. A bottom 90*a* of the base member 90 is configured as a planar surface to seat on the interior surface 24 of the enclosure door 20 (see also FIG. 1). A top 90*b* of the base member 90 includes a set of radially outer support surfaces configured as helical surfaces 92 and 94. Each of the helical surfaces 92 and 94 extends approximately halfway around a local circumference of the base member 90 and slope generally upward along the counter-clockwise direction (as viewed from the top of the base member 90). Generally, the helical surfaces 92 and 94 exhibit slopes that are complimentary (e.g., equal but opposite) to the slopes of the helical surfaces 42 and 44 of the guide member 40, so that the helical surfaces 42 and 44 can be seated relatively firmly on the helical surfaces 92 and 94. A generally vertical stop 92*a* is included between the helical surface 92 and the helical surface 94, and a generally vertical stop 94*a* is provided between the helical surface 94 and the helical surface 92.

In the embodiment illustrated, the helical surfaces 92 and 94 are interrupted by protrusions 96 and 98 that extend upward from the helical surfaces 92 and 94, respectively. The protrusions 96 and 98 are illustrated as rectangular protrusions, with heights that are somewhat smaller than the internal depth of the recesses 46 and 48 (see, e.g., FIG. 4). In other embodiments, other configurations are possible.

The base member 90 also includes a set of radially inner support surfaces configured as helical surfaces 100 and 102. Each of the helical surfaces 100 and 102 extend approximately halfway around a local circumference of the base member 90 and slope generally upward along the counter-clockwise direction (as viewed from the top of the base member 90). Generally, the helical surfaces 100 and 102 exhibit slopes that are complimentary to the slopes of the helical surfaces 58 and 60 of the guide member 40, so that the helical surfaces 58 and 60 can be seated relatively firmly on the helical surfaces 100 and 102.

A generally vertical stop 100*a* is included between the helical surface 100 and the helical surface 102, and a generally vertical stop 102*a* is provided between the helical surface 102 and the helical surface 100. In the embodiment illustrated, the each of the stops 100*a* and 102*a* is disposed approximately halfway between the stops 92*a* and 94*a* of the helical surfaces 92 and 94, similarly to the stops 58*a* and 60*a* relative to the stops 42*a* and 44*a* (see FIG. 4). Accordingly, when the helical surfaces 42, 44, 58 and 60 are seated on the helical surfaces 92, 94, 100, and 102, with the guide member 40 in one rotational orientation, the stops 92*a*, 94*a*, 100*a*, and 102*a* can also be seated against the stops 44*a*, 42*a*, 58*a*, and 60*a*, respectively. In other embodiments, other configurations are possible.

In the embodiment illustrated, the helical surfaces 100 and 102 are not interrupted by protrusions or recesses. In other embodiments, other configurations are possible. For example, one or both of the helical surfaces 100 and 102 can be interrupted by protrusions (not shown) similar to the protrusions 96 and 98 as an alternative (or in addition) to the helical surfaces 100 and 102 being interrupted by the protrusions 96 and 98. Likewise, in some embodiments, one or both of the helical surfaces can alternatively (or additionally) be interrupted by recesses of various types.

The base member 90 also includes a central attachment opening 104 extending fully through the base member 90. Generally, the attachment opening 104 can be sized to accommodate passage of the same fastener (e.g., the same screw, bolt, rod or peg) as the attachment opening 76 of the guide member 40 (see, e.g., FIG. 4). In this way, for example, a fastener can be used to secure the base member 90 and the guide member 40 together, as well as to collectively and rotationally secure the base member 90 and the guide member 40 to the enclosure door 20. In the embodiment illustrated, the attachment opening 104 is wider than the attachment opening 76, so that the boss 78 on the guide member 40 can be rotatably received within the attachment opening 104.

Figure 6:
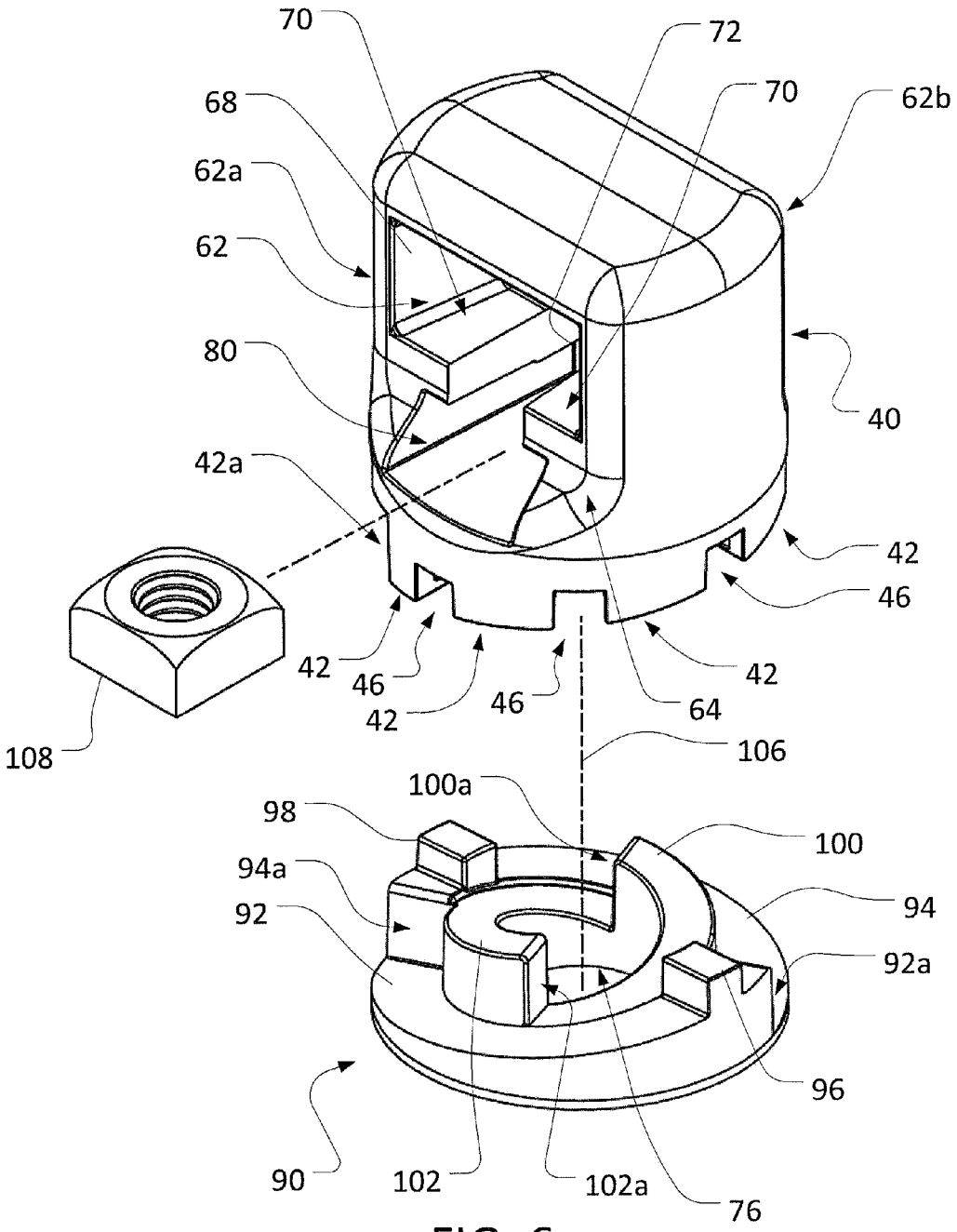
FIG. 6 is an exploded perspective view of the rod guide of FIG. 1, including the guide member of FIG. 4 and the base member of FIG. 5.
Figures 7, 8:
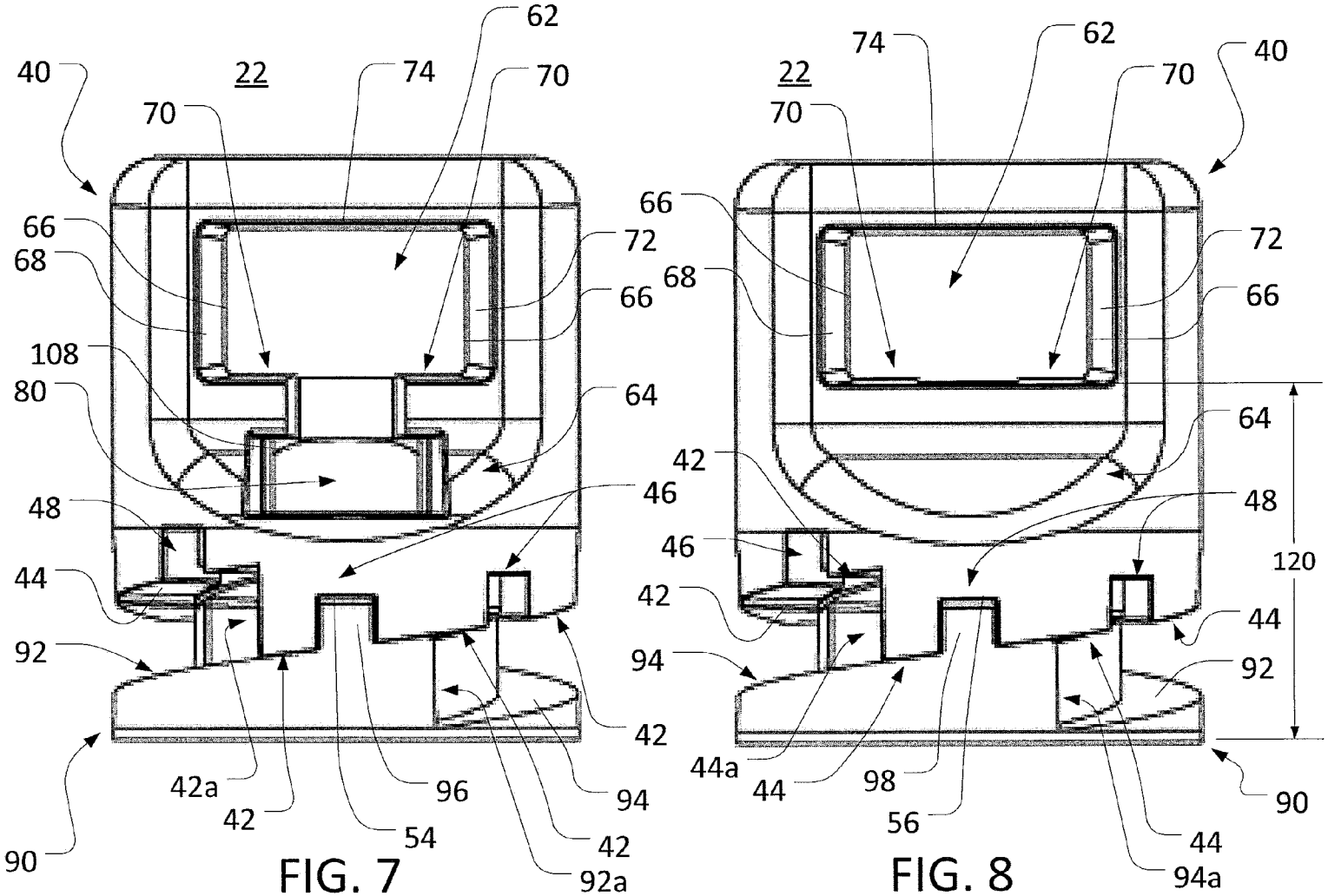
FIG. 7 is a front elevation view of the rod guide of FIG. 1 in a first orientation.
FIG. 8 is a rear elevation view of the rod guide of FIG. 1 in the first orientation.

As illustrated in FIGS. 6 through 8, to assemble the rod guide 22, the guide member 40 can be aligned axially above the base member 90, with the attachment openings 76 and 104 (see also FIG. 4) collectively defining a central axis 106 for the rod guide 22. The guide member 40 can be disposed at a desired rotational orientation relative to the base member 90 (as also discussed below) and the helical surfaces 42, 44, 58, and 60 (see also FIG. 4) seated on the helical surfaces 92, 94, 100, and 102, respectively, with the boss 78 extending into the attachment opening 104, and the protrusions 96 and 98 extending one of the recesses 46 and 48, respectively. A fastener, such as a square nut 108, can be inserted into the fastener recess 80 and another fastener, such as a screw, bolt, rod or peg (not shown), can be extended through the attachment openings 76 and 104, along the central axis 106, to engage the nut 108 and secure the guide member 40 and the base member 90 together (and, as desired, to the enclosure door 20). Because the fastener recess 80 can prevent rotation of the nut 108, the fastener that extends through the attachment openings 76 and 104 to engage the nut 108 can be tightened into the nut 108 in order to secure the rod guide 22 to the enclosure door 20.

To secure the rod guide 22 to the enclosure door 20 (or another feature of another enclosure), a fastener (e.g., the screw, bolt, rod, or peg (not shown)) can be inserted through a fastener opening in the enclosure door 20, before being extended through the attachment openings 76 and 104 to engage the nut 108. In this way, for example, the rod guide 22 can be rotationally attached to the enclosure door 20 at a single attachment point. As shown in FIGS. 2 and 3, this can allow the rod guides 22 to pivot to accommodate the pivoting of the latch rods 36, when the latch rods 36 are moved between latched and unlatched configurations. Further, as the latch rods 36 and the rod guides 22 pivot, the taper of the side walls 72 of the rod-guide passage can allow the latch rods 36 to pivot relative to the rod guides 22, without excessively stressing the material of the rod guides 22 or the latch rods 36.

As also noted above, the height of the protrusions 96 and 98 on the helical surfaces 92 and 94 of the base member 90 is somewhat smaller than the depth of the recesses 46 and 48 on the helical surfaces 42 and 44 of the guide member 40. As illustrated in FIGS. 7 and 8, for example, this can allow the helical surfaces of the guide member 40 (e.g., the helical surface 42) to seat firmly on the helical surfaces of the base member 90 (e.g., the helical surface 92) without the protrusions 96 and 98 contacting the inner end walls 54 and 56 of the recesses 46 and 48. Accordingly, axial loads can be transmitted between the guide member 40 and the base member 90 mainly via the helical surfaces 42, 44, 58, 60, 92, 94, 100, and 102, rather than via the protrusions 96 and 98.

In the assembled configuration illustrated in FIGS. 7 and 8, the protrusions 96 and 98 extend into the recesses 46 and 48 on the guide member 40 that are closest to the vertical stops 42*a* and 44*a*, respectively. This configuration corresponds to a relatively large distance 120 (see FIG. 8) between the guide opening 62 and the bottom of the base member 90 and, accordingly, between the guide opening 62 and the interior surface 24 of the enclosure door 20 (see, e.g., FIG. 1). Accordingly, with the rod guide 22 assembled as in FIGS. 7 and 8, the relevant latch rod 36 can be disposed at the relatively large distance 120 from the interior surface 24 of the enclosure door 20. This may be a useful orientation for the latch rod 36 for a particular configuration of an enclosure, gasket or other feature.

Figure 9:
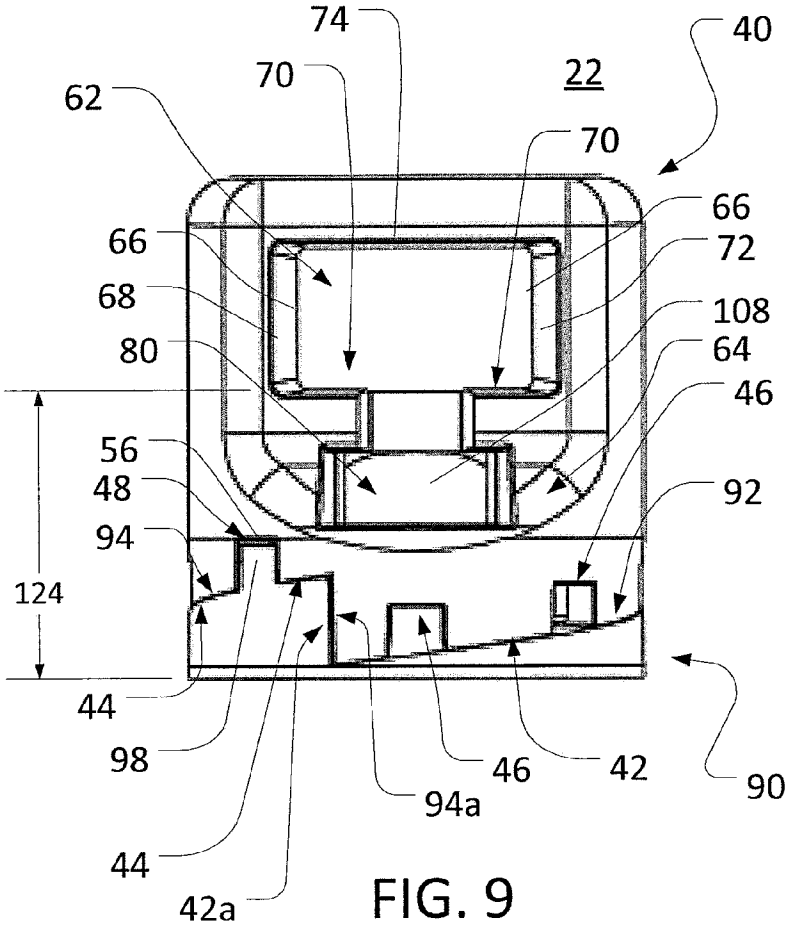
FIG. 9 is a front elevation view of the rod guide of FIG. 1 in a second orientation.

In other configurations, the rod guides 22 can be supported, and can support the latch rods 36, at different distances from the interior surface 24 of the enclosure door 20, as may be useful for other configurations of an enclosure, gasket, and so on. As illustrated in FIG. 9, for example, the guide member 40 can be seated on the base member 90 with the stop 42*a* seated against the stop 94*a* and the protrusion 98 extending into the recess 48 that is closest to the stop 42*a*. Likewise, although hidden from view in FIG. 9, the stop 44*a* can be seated against the stop 92*a* with the protrusion 96 extending into the recess 46 that is closest to the stop 44*a*. This can, for example, provide a relatively small distance 124 between the guide opening 62 and the interior surface 24 of the enclosure door 20 (see, e.g., FIG. 1), with corresponding implications for the latch rod 36 received through the guide opening 62.

Figure 10:
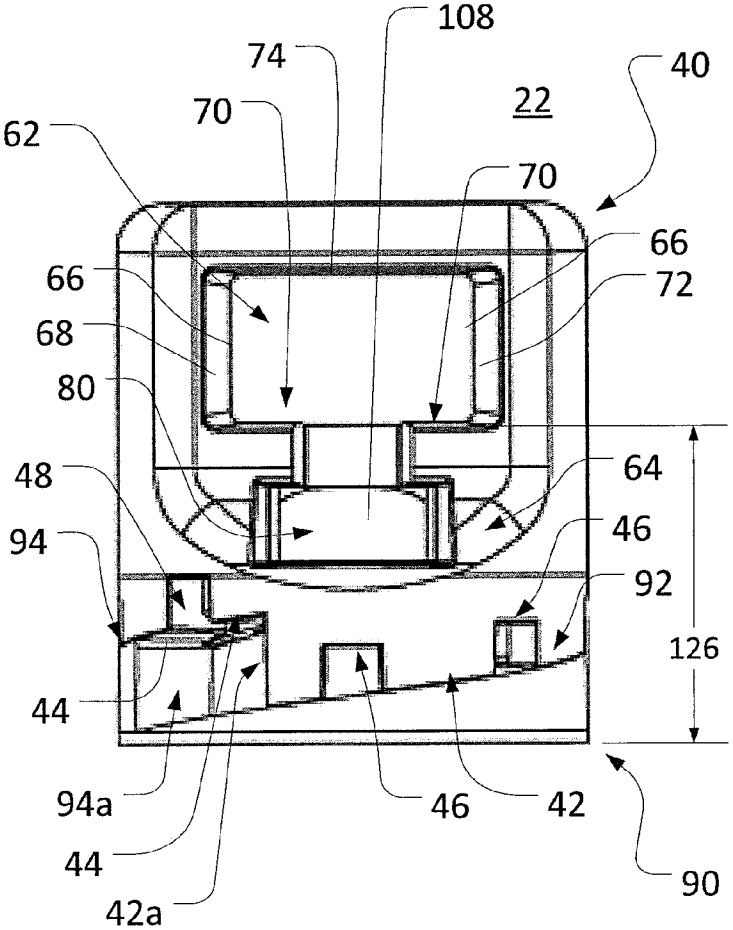
FIG. 10 is a front elevation view of the rod guide of FIG. 1 in a third orientation.
Figure 11:
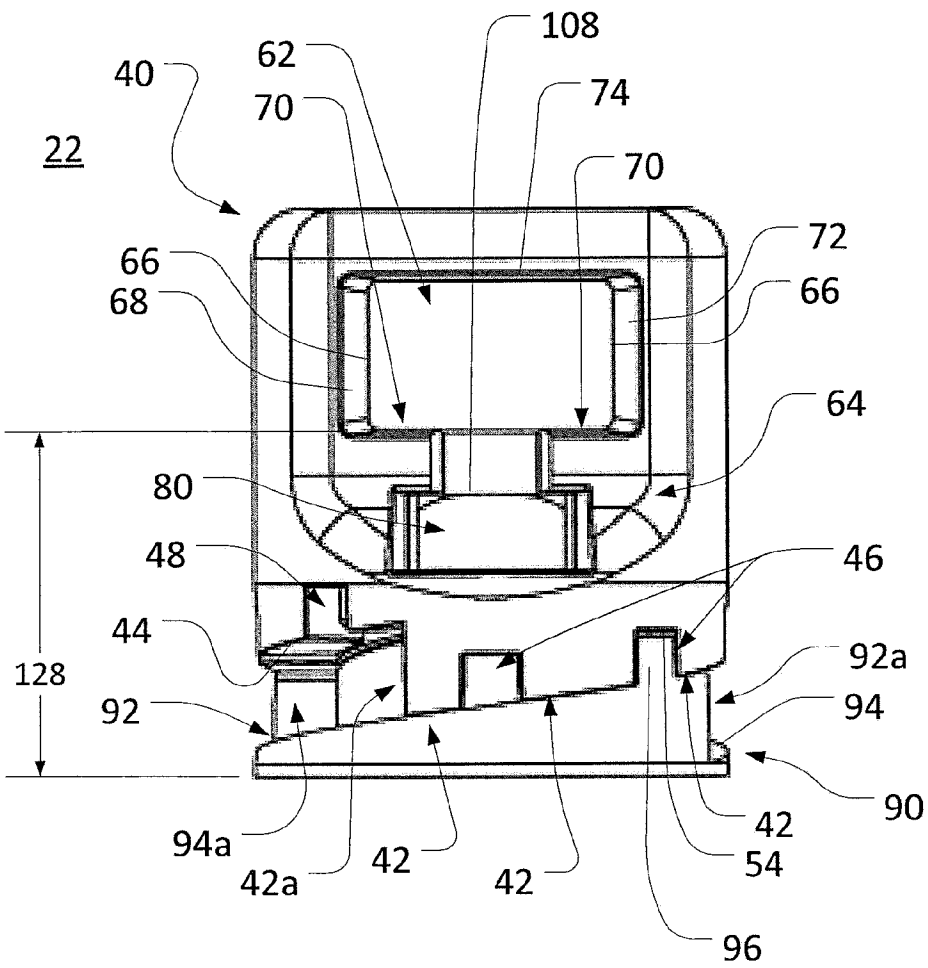
FIG. 11 is a front elevation view of the rod guide of FIG. 1 in a fourth orientation.

In similar fashion, as illustrated in FIGS. 8, 10 and 11, by varying the rotational orientation of the guide member 40 relative to the base member 90 before seating the helical surfaces 42, 44, 58, 60, 92, 94, 100, and 102 together, and as guided by the alignment of the protrusions 96 and 98 with various of the recesses 46 and 48, the height of the guide opening 62 can be varied to accommodate different latching or enclosure configurations. For example, one alignment of the protrusions 96 and 98 with the recesses 46 and 48 can provide a first intermediate distance 126 (see FIG. 10), another alignment can provide a second intermediate distance 128 (see FIG. 11), and still another alignment can provide the relatively large distance 120 (see FIG. 8, as also discussed above). Further, due to the complimentary geometry of the various helical surfaces 42, 44, 58, 60, 92, 94, 100, and 102, the guide member 40 can be supported relatively firmly by the base member 90 at each of the orientations noted above (e.g., regardless of the rotational orientation of the guide member 40 relative to the base member 90). (For convenience of presentation, the perspective of FIGS. 9 through 11 has been maintained constant with respect to the guide member 40, rather than to the base member 90.)

In some embodiments, indicators can be provided to alert an operator as to the height of the guide opening 62 that corresponds to insertion of one of the protrusions 96 and 98 into a particular one of the recesses 46 and 48. For example, numerical indicators can be provided in the recesses 46 and 48 (e.g., as with numerical indicator 130 in FIG. 4) or elsewhere on the guide member 40 or the base member 90 (not shown), in order to help an operator determine an appropriate relative rotational orientation for the guide member 40.

In different embodiments, the guide member 40 and the base member 90 can be formed from different materials. In some embodiments, non-metallic materials, such as plastics or other polymers, can be used. In some embodiments, the use of non-metallic materials can result in generally quieter operation of the latching system 32 and in reduced wear on different components.

Figure 12A:
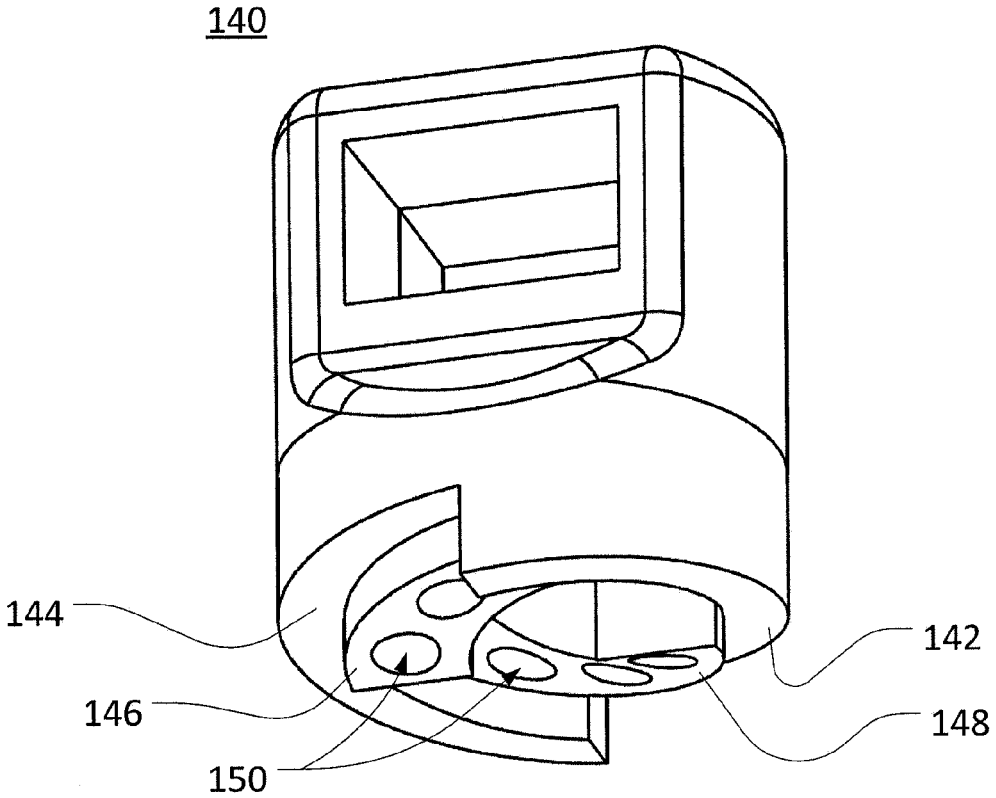
FIG. 12A is a left, front, bottom perspective view of another guide member for the rod guide of FIG. 1.

In some embodiments, protrusions or recesses for securing guide members at particular rotational orientations relative to base members can exhibit non-rectangular cross-sectional profiles. As illustrated in FIG. 12A, for example, a guide member 140 can be configured generally similarly to the guide member 40, including with support surfaces configured as radially outer helical surfaces 142 and 144 and as radially inner helical surfaces 146 and 148. In contrast to the guide member 40, however, the guide member 140 include generally cylindrical recesses 150 extending into the radially inner helical surfaces 146 and 148.

Figure 12B:
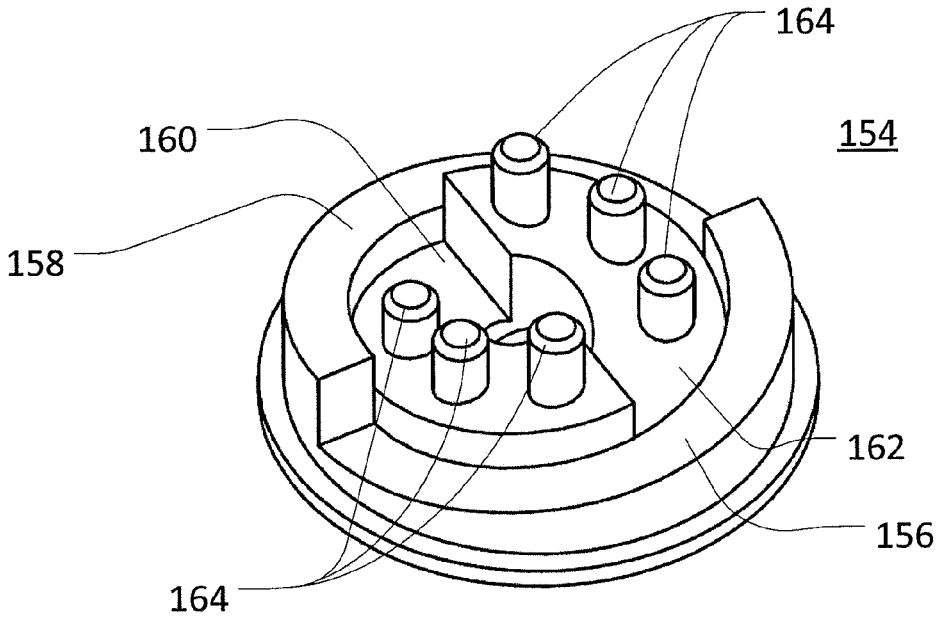
FIG. 12B is a left, front, top perspective view of another base member for the rod guide of FIG. 1.

Similarly, as illustrated in FIG. 12B, a base member 154 for use with the guide member 140 can be configured generally similarly to the base member 90, including with support surfaces configured as radially outer helical surfaces 156 and 158 and as radially inner helical surfaces 160 and 162. Further, the helical surfaces 156, 158, 160 and 162 can exhibit a generally complimentary geometry to the helical surfaces 142, 144, 146 and 148 of the guide member 140. In contrast to the base member 90, however, the base member 154 includes generally cylindrical protrusions 164 that extend out of the radially inner helical surfaces 160 and 162 and that are generally complimentary to the recesses 150 on the guide member 140.

Accordingly, in the embodiment illustrated, the guide member 140 can be disposed at different rotational orientations relative to the base member 154, as determined by aligning the protrusions 164 with appropriate sets of the recesses 152. The helical surfaces 142, 144, 146 and 148 of the guide member 140 can then be seated on the helical surfaces 156, 158, 160 and 162 of the base member 154, with the protrusions 164 extending into a corresponding set of the recesses 152, to allow the base member 154 to support the guide member 140 at different corresponding distances from a relevant enclosure surface (e.g., the interior surface 24 of the enclosure door 20).

Figure 13A:
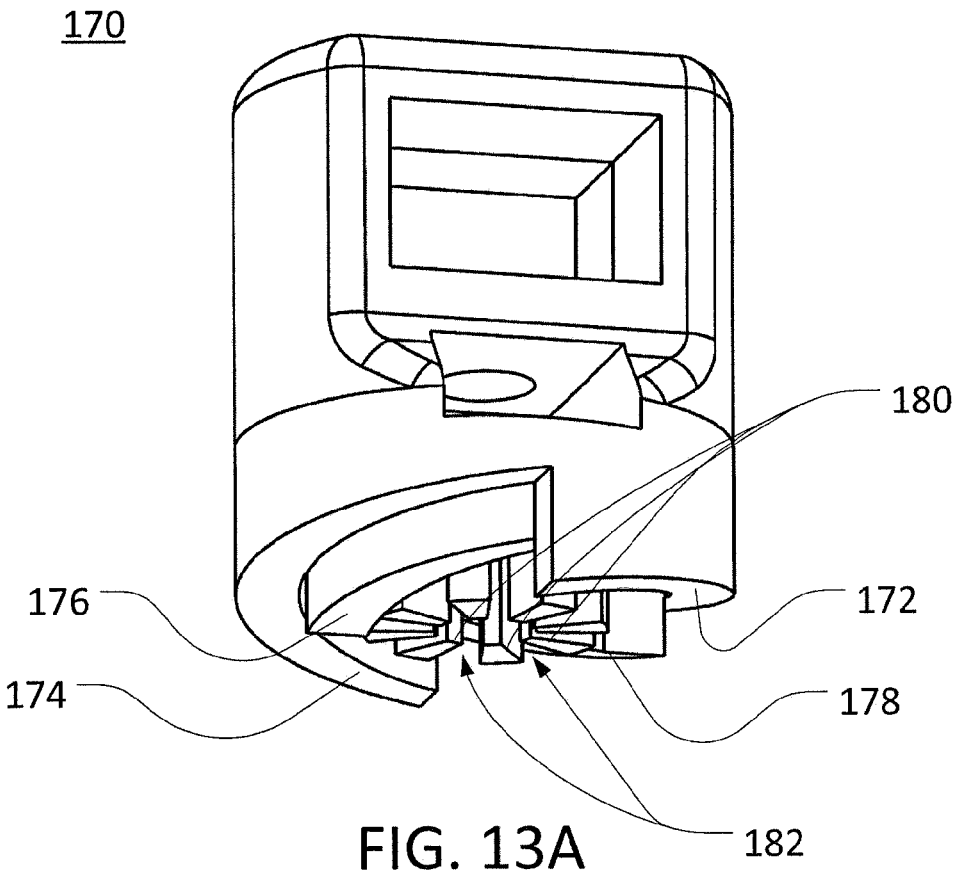
FIG. 13A is a right, front, bottom perspective view of still another guide member for the rod guide of FIG. 1.

In some embodiments, protrusions or recesses for securing guide members at particular rotational orientations relative to base members can be disposed on features other than the relevant support surfaces. As shown in FIG. 13A, for example, a guide member 170 can be configured generally similarly to the guide members 40 and 140, including with support surfaces configured as radially outer helical surfaces 172 and 174 and as radially inner helical surfaces 176 and 178. In contrast to the guide members 40 and 140, however, there are no engagement features extending into or out of the radially outer helical surfaces 172 and 174 or the radially inner helical surfaces 176 and 178. Instead, the guide member 170 includes a ring of interspaced trapezoidal protrusions 180 and trapezoidal recesses 182 that is generally disposed radially inwardly from the radially inner helical surfaces 176 and 178.

Figure 13B:
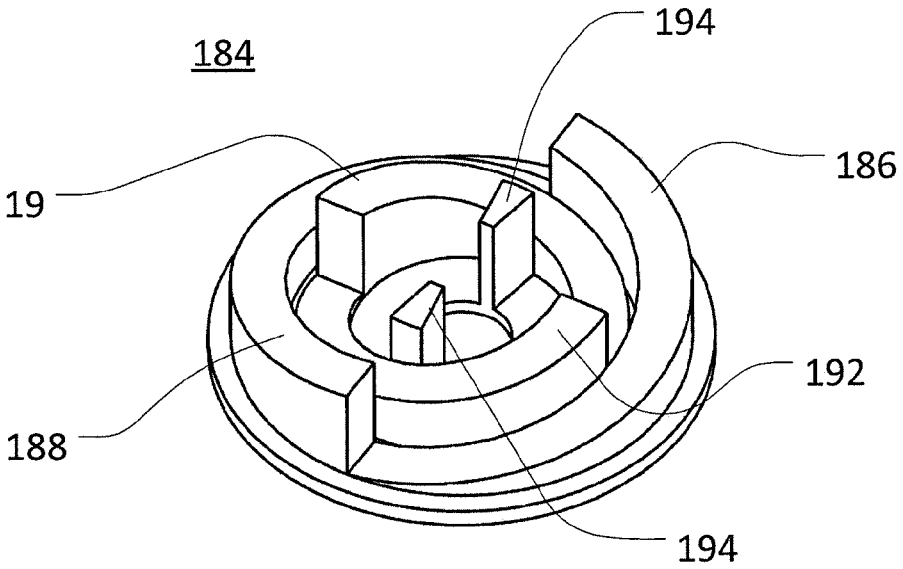
FIG. 13B is a right, front, top perspective view of still another base member for the rod guide of FIG. 1.

Similarly, as shown in FIG. 13B, a base member 184 for use with the guide member 170 can be configured generally similarly to the base members 90 and 154, including with support surfaces configured as radially outer helical surfaces 186 and 188 and as radially inner helical surfaces 190 and 192. Further, the helical surfaces 186, 188, 190 and 192 can exhibit a generally complimentary geometry to the helical surfaces 172, 174, 176 and 178 of the guide member 170. In contrast to the base members 90 and 154, however, the base member 184 includes no engagement features extending into or out of the radially outer helical surfaces 186 and 188 or the radially inner helical surfaces 190 and 192. Instead, the base member 184 includes a set of trapezoidal protrusions 194 that are disposed radially inward from the radially outer helical surfaces 190 and 192, and that have generally complimentary geometry as the trapezoidal recesses 182 on the guide member 170.

Accordingly, in the embodiment illustrated, the guide member 170 can be disposed at different rotational orientations relative to the base member 184, as determined by aligning the protrusions 194 with appropriate sets of the recesses 182. The helical surfaces 172, 174, 176 and 178 of the guide member 170 can then be seated on the helical surfaces 186, 188, 190 and 192 of the base member 184, with the protrusions 194 extending into a corresponding set of the recesses 182, to allow the base member 184 to support the guide member 170 at different corresponding distances from a relevant enclosure surface (e.g., the interior surface 24 of the enclosure door 20).

Figure 14A:
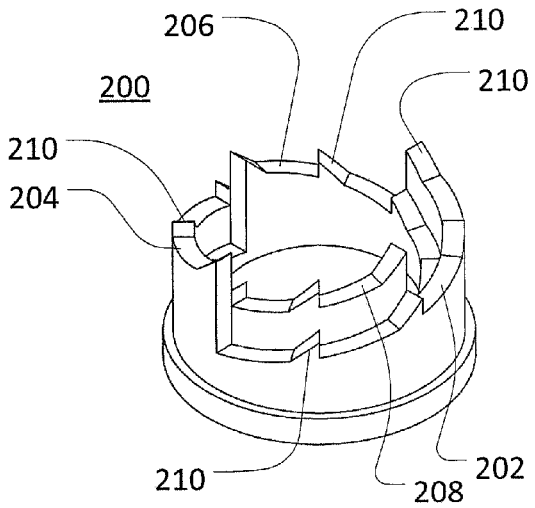
FIGS. 14A through 15B are right, front top perspective views of further base members for the rod guide of FIG. 1.

In other embodiments, other configurations of support surfaces, protrusions, recesses, and so on may be possible. As illustrated in FIG. 14A, for example, a base member 200 for use with a rod guide according to this disclosure includes support surfaces configured as radially nested helical surfaces 202, 204, 206, and 208 with various angled protrusions 210. A corresponding guide member (not shown) can accordingly include a set of similarly configured helical surfaces with complimentary angled recesses. This arrangement may be useful, for example, in order to more strongly restrain the guide member (not shown) from rotating relative to the base member 200 in one direction than another.

Figure 14B:
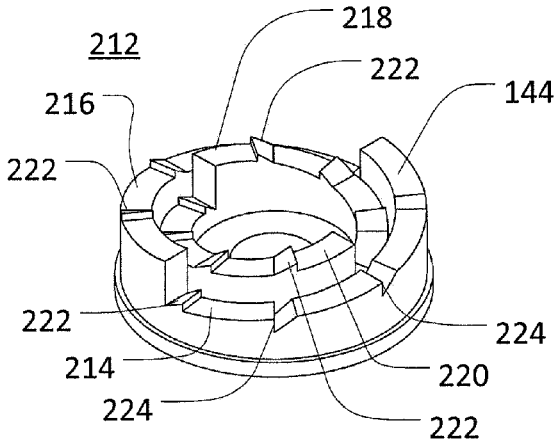

As another example, as illustrated in FIG. 14B, a base member 212 for use with a rod guide according to this disclosure includes support surfaces configured as radially nested helical surfaces 214, 216, 218, and 220 with a combination of angled protrusions 222 and angled recesses 224. A corresponding guide member (not shown) can accordingly include a set of similarly configured helical surfaces with complimentary angled recesses and protrusions. This arrangement may also be useful, for example, in order to more strongly restrain the guide member (not shown) from rotating relative to the base member 212 in one direction than another.

Figure 14C:
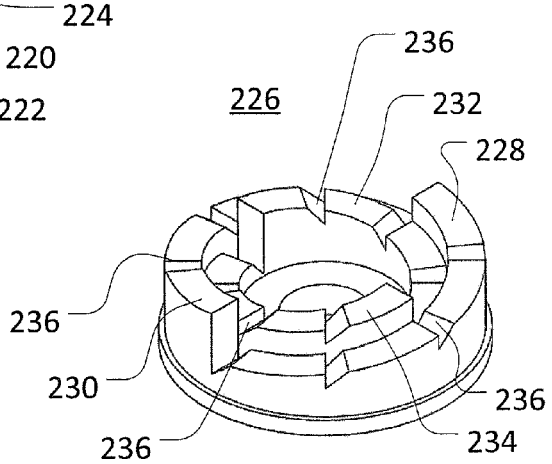

As another example, as illustrated in FIG. 14C, a base member 226 for use with a rod guide according to this disclosure includes support surfaces configured as radially nested helical surfaces 228, 230, 232, and 234 with various angled recesses 236. A corresponding guide member (not shown) can accordingly include a set of similarly configured helical surfaces with complimentary angled protrusions. This arrangement may also be useful, for example, in order to more strongly restrain the guide member (not shown) from rotating relative to the base member 226 in one direction than another.

In some embodiments, a base member can be configured with a single set of radially coextensive support surfaces. As illustrated in FIG. 15A, for example, a base member 238 for use with a rod guide according to this disclosure includes a set of radially coextensive helical surfaces 240 with various angled protrusions 242. A corresponding guide member (not shown) can accordingly include a set of similarly radially coextensive helical surfaces with corresponding angled recesses. This arrangement may also be useful, for example, in order to more strongly restrain the guide member (not shown) from rotating relative to the base member 238 in one direction than another.

Figure 15B:
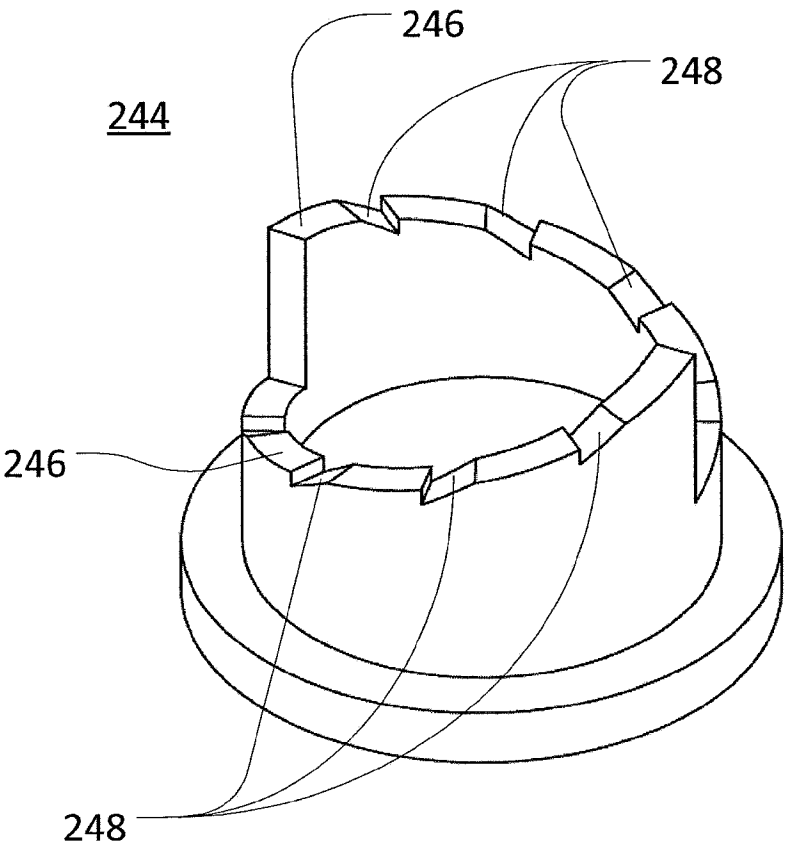
Figure 15A:
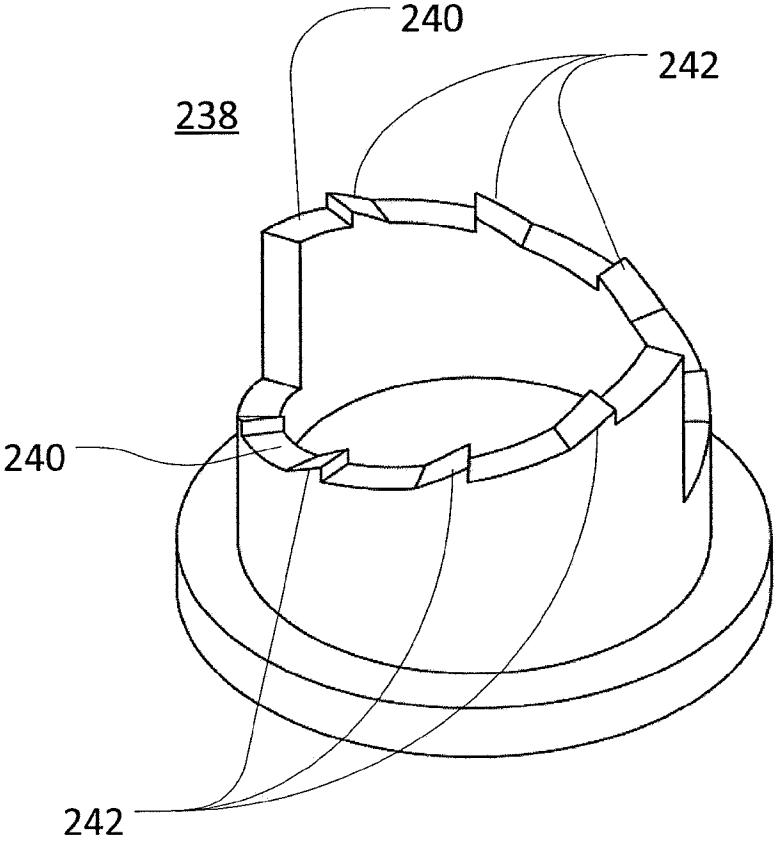

As another example, as illustrated in FIG. 15B, a base member 244 for use with a rod guide according to this disclosure includes a set of radially coextensive helical surfaces 246 with various angled recesses 248. A corresponding guide member (not shown) can accordingly include a set of similarly radially coextensive helical surfaces with corresponding angled protrusions. This arrangement may also be useful, for example, in order to more strongly restrain the guide member (not shown) from rotating relative to the base member 244 in one direction than another.

It will be understood that different embodiments not expressly discussed can include various combinations of the features described above. For example, in some embodiments, a base member with a single set of radially coextensive helical surfaces, such as those illustrated in FIGS. 15A and 15B, can include a combination of recesses and protrusions on the helical surfaces. Likewise, in some embodiments, base members or guide members can include a variety of combinations of protrusions, recesses, or other engagement features, configured in a variety of different ways.

Thus, embodiments of the invention provide for an improved rod guide for use with enclosures, which can allow for relatively easy adjustment of the distance from a relevant surface (e.g., an interior surface of an enclosure door) at which the rod guide supports a rod. This can be useful, for example, in order to allow a single rod guide to be used with a variety of enclosures or enclosure doors that exhibit different gasket thicknesses or durometer values, different body flange geometries, or other relevant variations.

The previous description of the disclosed embodiments is provided to enable any person skilled in the art to make or use the invention. Various modifications to these embodiments will be readily apparent to those skilled in the art, and the generic principles defined herein may be applied to other embodiments without departing from the spirit or scope of the invention. Thus, the invention is not intended to be limited to the embodiments shown herein but is to be accorded the widest scope consistent with the principles and novel features disclosed herein.

The invention claimed is:

1. A rod guide for mounting a latch rod relative to an enclosure, the rod guide comprising:

a guide member including a guide-member helical surface and a guide opening to receive the latch rod;

a base member configured to attach to a surface of the enclosure, the base member including a base-member helical surface;

the base member supporting the guide member with the guide opening disposed at different distances from the surface of the enclosure when the guide-member helical surface is seated on the base-member helical surface with the guide member disposed at different respective rotational orientations relative to the base member;

a first fastener configured to secure the base member and the guide member to the enclosure;

a first at least one engagement feature disposed along one of the guide-member helical surface and the base-member helical surface;

a second at least one engagement feature disposed along a different one of the guide-member helical surface and the base-member helical surface;

wherein, with guide-member helical surface seated on the base-member helical surface and with the base member attached to the surface of the enclosure, the first at least one engagement feature engages the second at least one engagement feature to secure the guide-member at a first rotational orientation relative to the base member and to secure the guide opening at a first distance from the surface of the enclosure.

2. The rod guide of claim 1, wherein the first at least one engagement feature includes a protrusion extending out of the one of the guide-member helical surface and the base-member helical surface;

wherein the second at least one engagement feature includes a first recess extending into the different one of the guide-member helical surface and the base-member helical surface; and wherein the first at least one engagement feature engages the second at least one engagement feature via the protrusion extending into the first recess.

3. The rod guide of claim 2, wherein, with the protrusion extending into the first recess, a free end of the protrusion is spaced apart from an inner end of the first recess.

4. The rod guide of claim 2, wherein the second at least one engagement feature further includes a second recess extending into the different one of the guide-member helical surface and the base-member helical surface;

wherein, with the guide-member helical surface seated on the base-member helical surface and with the base member attached to the surface of the enclosure, the protrusion extends into the second recess to secure the guide-member at a second rotational orientation relative to the base member and to secure the guide opening at a second distance from the surface of the enclosure.

5. The rod guide of claim 1, wherein, with the base member attached to the surface of the enclosure and with the guide-member helical surface seated on the base-member helical surface, the guide member and the base member are collectively rotatable relative to the surface of the enclosure.

6. The rod guide of claim 5, wherein the base member includes a base-member mounting bore;

wherein the guide member includes a guide-member mounting bore and a fastener seat; and wherein the base member is secured to the guide member via the first fastener extending through the surface of the enclosure, the base-member mounting bore, and the guide-member mounting bore to engage a second fastener that is seated in the fastener seat.

7. The rod guide of claim 1, wherein the guide-member helical surface is a first guide-member helical surface and the guide member further includes a second guide-member helical surface;

wherein the base-member helical surface is a first base-member helical surface and the base member further includes a second base-member helical surface; and wherein, with the guide member disposed at the different respective rotational orientations relative to the base member, the base member further supports the guide member with the guide opening disposed at the different distances from the surface of the enclosure via the second guide-member helical surface being seated on the second base-member helical surface.

8. The rod guide of claim 7, wherein the first guide-member helical surface is disposed radially outwardly from the second guide-member helical surface; and wherein the first base-member helical surface is disposed radially outwardly from the second base-member helical surface.

9. The rod guide of claim 1 wherein a third at least one engagement feature is disposed at least partly radially inwardly from the guide-member helical surface; and wherein a fourth at least one engagement feature is disposed at least partly radially inwardly from the base-member helical surface.

10. The rod guide of claim 1, wherein the rod guide opening includes a rod-guide passage with a first open end and a second open end; and wherein a first cross-sectional area of the rod-guide passage at a region between the first open end and the second open end is smaller than a second cross-sectional area of the rod-guide passage at at least one of the first open end and the second open end.

11. The rod guide of claim 10, wherein the rod-guide passage includes a first side wall and a second side wall; and wherein at least one of the first side wall and the second side wall tapers inwards between the at least one of the first open end and the second open end and the region between the first open end and the second open end.

12. A latching system for a door of an enclosure, the latching system comprising:

a guide member including a guide-member support surface, a guide opening, and a first at least one engagement feature;

a latch rod received in the guide opening;

a base member configured to rotatably attach to an interior surface of the door, the base member including a base-member support surface;

the base member supporting the guide member with the guide opening disposed at different distances from the interior surface of the door when the guide-member support surface is seated on the base-member support surface with the guide member disposed at different respective rotational orientations relative to the base member;

a first fastener configured to secure the base member and the guide member to the enclosure;

the latch rod being disposed at different respective operational distances from the interior surface of the door when the guide opening is disposed at the different distances from the interior surface of the door;

the guide member and the base member being collectively rotatable relative to the interior surface of the door when the base member is attached to the interior surface of the door and the guide-member support surface is seated on the base-member support surface;

wherein the base member includes a second at least one engagement feature; and wherein, with the guide-member support surface seated on the base-member support surface and with the base member attached to the interior surface of the door, the first at least one engagement feature engages the second at least one engagement feature to secure the guide-member at a first rotational orientation relative to the base member and to secure the guide opening at a first distance from the interior surface of the door.

13. The latching system of claim 12, wherein the guide-member support surface is a first guide-member support surface and the guide member further includes a second guide-member support surface;

wherein the base-member support surface is a first base-member support surface and the base member further includes a second base-member support surface; and wherein, with the guide member disposed at the different respective rotational orientations relative to the base member, the base member further supports the guide member with the guide opening disposed at the different distances from the interior surface of the door via the second guide-member support surface being seated on the second base-member support surface.

14. The latching system of claim 13, wherein the first guide-member support surface is a first guide-member helical surface and the second guide-member support surface is a second guide-member helical surface; and wherein that first base-member support surface is a first base-member helical surface and the second base-member support surface is a second base-member helical surface.

15. The latching system of claim 14, wherein the first guide-member helical surface is disposed radially outwardly from the second guide-member helical surface, and wherein the first base-member helical surface is disposed radially outwardly from the second base-member helical surface.

16. The latching system of claim 12, wherein the rod guide opening includes a rod-guide passage with a first open end and a second open end; and wherein a first cross-sectional area of the rod-guide passage at a region between the first open end and the second open end is smaller than a second cross-sectional area of the rod-guide passage at at least one of the first open end and the second open end.

17. A rod guide for mounting a latch rod relative to an enclosure, the rod guide comprising:

a guide member including a first guide-member helical surface and a guide opening to receive the latch rod;

a base member configured to attach to a surface of the enclosure, the base member including a first base-member helical surface;

a first protrusion extending out of one of the first guide-member helical surface and the first base-member helical surface; and a first plurality of recesses extending into a different one of the first guide-member helical surface and the first base-member helical surface;

a first fastener configured to secure the base member and the guide member to the enclosure;

the base member supporting the guide member relative to the surface of the enclosure via the first guide-member helical surface being seated on the first base-member helical surface;

when the base member is attached to the surface of the enclosure and the first guide-member helical surface is seated on the first base-member helical surface with the guide member disposed at a first rotational orientation relative to the base member:

the guide opening being disposed at a first distance from the surface of the enclosure; and the first protrusion extending into a first recess of the first plurality of recesses to secure the guide-member at the first rotational orientation relative to the base member and to secure the guide opening at the first distance from the surface of the enclosure; and when the base member is attached to the surface of the enclosure and the first guide-member helical surface is seated on the first base-member helical surface with the guide member disposed at a second rotational orientation relative to the base member:

the guide opening being disposed at a second distance from the surface of the enclosure; and the first protrusion extending into a second recess of the first plurality of recesses to secure the guide-member at the second rotational orientation relative to the base member and to secure the guide opening at the second distance from the surface of the enclosure.

18. The rod guide of claim 17, wherein the guide member includes a second guide-member helical surface;

wherein the base member includes a second base-member helical surface;

wherein a second protrusion extends out of one of the second guide-member helical surface and the second base-member helical surface;

wherein a second plurality of recesses extend into a different one of the second guide-member helical surface and the second base-member helical surface;

wherein the base member further supports the guide member relative to the surface of the enclosure via the second guide-member helical surface being seated on the second base-member helical surface;

wherein, when the base member is attached to the surface of the enclosure and when the second guide-member helical surface is seated on the second base-member helical surface with the guide member disposed at the first rotational orientation relative to the base member, the second protrusion extends into a first recess of the second plurality of recesses to further secure the guide-member at the first rotational orientation relative to the base member and to further secure the guide opening at the first distance from the surface of the enclosure; and wherein, when the base member is attached to the surface of the enclosure and when the second guide-member helical surface is seated on the second base-member helical surface with the guide member disposed at the second rotational orientation relative to the base member, the second protrusion extends into a second recess of the second plurality of recesses to secure the guide-member at the second rotational orientation relative to the base member and to secure the guide opening at the second distance from the surface of the enclosure.

19. The rod guide of claim 17, wherein the base member includes a second base-member helical surface disposed radially inwardly from the first base-member helical surface;

wherein the guide member includes a second guide-member helical surface disposed radially inwardly from the first guide-member helical surface; and wherein, the base member further supports the guide member relative to the surface of the enclosure via the second guide-member helical surface being seated on the second base-member helical surface.

* * * * *